United States Patent [19]

Miller

[11] Patent Number: 4,828,884

[45] Date of Patent: May 9, 1989

[54] METHOD AND APPARATUS FOR COATING THE RIMS OF CONTAINERS

[75] Inventor: Paul A. Miller, Brockway, Pa.

[73] Assignee: Brockway, Inc. (NY), Brockway, Pa.

[21] Appl. No.: 29,669

[22] Filed: Mar. 24, 1987

[51] Int. Cl.[4] ..... B05D 5/00; B05D 1/28; B05C 1/14

[52] U.S. Cl. ..... 427/284; 118/211; 118/257; 427/287

[58] Field of Search ..... 118/211, 257; 427/284, 427/287

[56] References Cited

U.S. PATENT DOCUMENTS 3,251,707 5/1966 Blank et al. ..... 427/284

*Primary Examiner*—Evan Lawrence

*Attorney, Agent, or Firm*—Burns, Doane, Swecker & Mathis

[57] ABSTRACT

The rims of containers are coated with a liquid substance by driving an endless applicator belt which carries the substance, the applicator belt including an application flight. The containers are advanced such that the container rims are exposed and in contact with the application flight to become coated with the substance. The containers are advanced in the same direction, and at the same speed, as the application flight. The containers are rotated about their longitudinal axes defined by the rims, while the rims are in contact with the application flight.

15 Claims, 3 Drawing Sheets

METHOD AND APPARATUS FOR COATING THE RIMS OF CONTAINERS

BACKGROUND OF THE INVENTION

The present invention relates to methods and apparatus for applying a coating to a rim or finish of a container.

In an effort to create an air seal around the rim, or finish, of a container such as a glass bottle, and/or to provide a means of detecting whether the contents have been tampered with, it has been conventional to attach a foil seal to the bottle rim after the product has been inserted into the bottle. The foil may comprise a piece of aluminum foil which carries a plastic heat seal substance. The foil is placed on the bottle rim with the heat seal substance facing the rim. Upon the application of heat, the heat seal substance melts and thereafter cures and bonds to the rim.

A problem experienced in connection with such a practice involves a tendency for the foil to become detached from the bottle when subjected to highly humid atmospheric conditions, e.g., during storage of the bottle.

One known solution to that problem involves the application of a conventional hydrophobic substance to the rim prior to placement of the foil thereagainst. Accordingly, the rim becomes hydrophobic and the bond between the foil and the rim will remain intact even in a highly humid environment.

The assignee of the present application has heretofore commercially utilized a number of different machines for applying substances to bottle rims. For example, in one machine, each bottle is individually gripped by a yoke and rotated beneath a stationary applicator, so that a liquid substance is wiped from the applicator onto the rim. However, such a procedure is relatively time-consuming and not well suited to mass production.

In another machine, an applicator was lowered into contact with the rim of an advancing bottle and displaced in the same direction and at the same speed as the bottle. The applicator was reciprocated up and down to daub a substance onto the rim. In a different embodiment of the same type of machine, the applicator was rotated 90° while held in contact with the rim in order to transfer the substance onto the rim by a wiping action. Following the application of the substance, the applicator was raised off the rim and returned to a start position to make contact with another bottle. Such an apparatus requires a relatively complicated mechanism for manipulating the applicator and is not able to treat bottles at as high a rate as would be desired for mass production.

In another machine, advancing bottles were passed beneath a roller applicator which rotated about a horizontal axis extending perpendicular to the direction of bottle travel. As a bottle rim contacted the applicator, a substance was transferred from the applicator to the rim.

Notwithstanding the technical advancements provided by the above-described apparatuses, room for improvement remains, especially from the standpoint of applying a coating to the bottle rims in a manner suited to mass production. Furthermore, the coating should be uniform and the substance should not run or drip downwardly along the side surface of the bottle.

SUMMARY OF THE INVENTION

The present invention relates to methods and apparatus for coating the rims of containers with a substance. An endless applicator belt which carries the substance is driven while containers are advanced such that the rims of the containers are exposed and in contact with the application flight to become coated with the substance.

Preferably, the containers are advanced in the same direction as the application flight. Also, it is preferred that the containers are advanced at the same speed as the application flight. It is further preferred that the containers are rotated about their longitudinal axes defined by the rims while the rims are in contact with the application flight.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

A preferred coating apparatus according to the present invention utilizes an endless belt 21 as an applicator. Such an applicator belt is highly suited to mass production and requires a very simple drive mechanism. Preferably, the bottles are advanced while in contact with the applicator belt, with the belt being advanced at the same speed and in the same direction as the bottles. Also, it is preferred that the bottles are rotated about longitudinal vertical axes defined by the rims while the rims are in contact with the applicator belt to impart a wiping of the substance onto the bottle rims.

Figure 1:
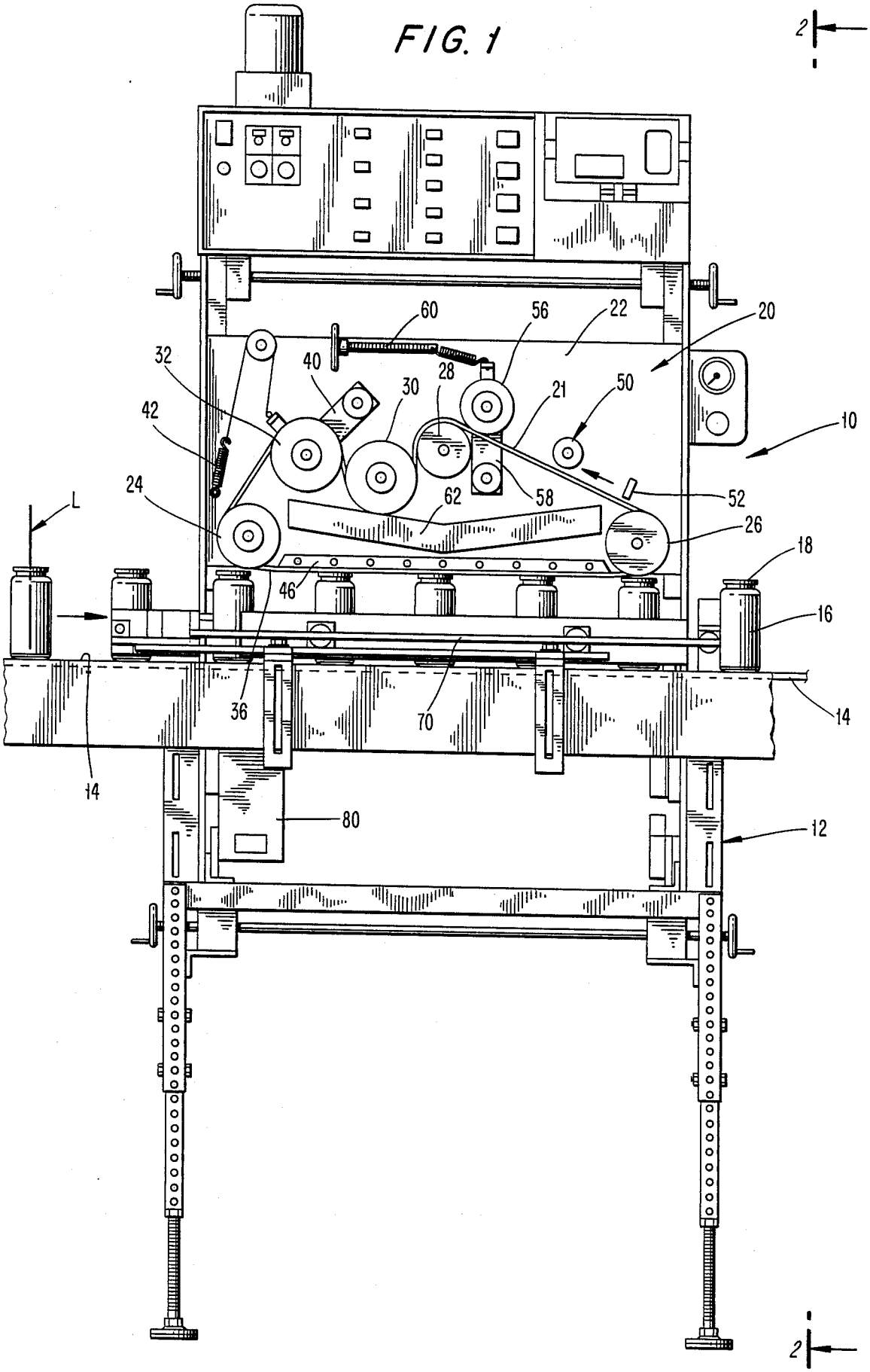
FIG. 1 is a front elevational view of a bottle coating apparatus according to the present invention, as bottles are conveyed therethrough.

Those operations are preferably performed by an apparatus 10 comprising a housing 12 on which a conveyor belt 14 is mounted for horizontal movement (e.g., from left to right as viewed in FIG. 1). The conveyor belt is driven by any suitable drive mechanism in conventional fashion. Alternatively, the use of other types of conveying devices will become apparent to those skilled in the art.

The conveyor belt 14 carries a series of upright containers 16, such as glass bottles, the upper rims 18 of which are exposed. The bottles are advanced past an applicator station 20 in which the endless applicator belt 21 is housed. The applicator belt is mounted on a frame 22 by means of a plurality of pulleys 24, 26, 28, 30 around which the applicator belt 21 extends. The pulleys are mounted to the frame for rotation about horizontal axes.

The applicator belt 21 is formed of any suitable liquid-absorbing material such as a woven Kevlar® material developed by DuPont. The belt 21 may comprise a single layer of material which is stitched together at its abutting ends, or a multi-layer belt having the layers stitched together such that the abutted ends of respective layers are circumferentially offset from one another.

The applicator belt 21 is arranged to provide a horizontal application flight 36 which extends between two of the pulleys 24, 26 disposed at respective ends of the application flight. One of these pulleys 26 is motor-driven to advance the applicator belt in endless fashion. The applicator belt passes around first and second support pulleys 28, 30 disposed above the application flight, and around a tensioning pulley 32. The latter is pivoted to the frame by an arm 40, and is spring-biased outwardly in a belt-tensioning manner by means of a tensioned coil spring 42 which is connected to the tensioning pulley by means of a cable 44. The first support pulley 28 is driven synchronously with the first-named drive pulley 26 to advance the applicator belt.

A reinforcing bar 46 is secured to the frame above the application flight to reinforce the horizontal flight from above.

Disposed above the applicator belt between the two drive pulleys 26, 28 is a liquid dispenser pipe 50. The substance to be coated on the bottle rims is dispensed through an open end of the pipe and deposited directly onto the applicator belt. The substance to be dispensed preferably comprises a liquid substance which renders the bottle rims hydrophobic. A valve 51 is connected to the dispenser pipe 50 and is actuated by a timer which periodically opens and closes the valve 51 to dispense the substance intermittently.

A sensor 52 is situated over the applicator belt upstream (with reference to the direction of belt travel) of the pipe 50 to sense the degree of moisture content in the applicator belt. If the applicator belt is not sufficiently moist, the sensor actuates an alarm to alert the operator.

The sensor preferably comprises a conventional electrical capacitance sensor which senses changes in the electrical capacitance of the belt. Since electrical capacitance is a function of the moisture content of the belt, signals from the sensor are utilized as an indicator of the belt moisture contact. One suitable sensor is marketed by Rechner Electronics Industries, Inc. of Niagara Falls, N.Y.

Disposed downstream of the dispenser pipe 50 is a rotary press roll 56 which is pivoted to the frame by an arm 58 and is biased toward the drive pulley 28 by means of a spring 60. The press roll 56 and drive pulley 28 form a nip therebetween through which the moistened applicator belt passes. In so doing, excess moisture is squeezed from the applicator belt and falls into a collection trough 62. The spring 60 exerts a constant force on the press roll so that the applicator belt always exits the nip at a uniform degree of moistness, thereby assuring that the coatings applied to the bottle rims will be uniform from one bottle to the next.

Figure 2:
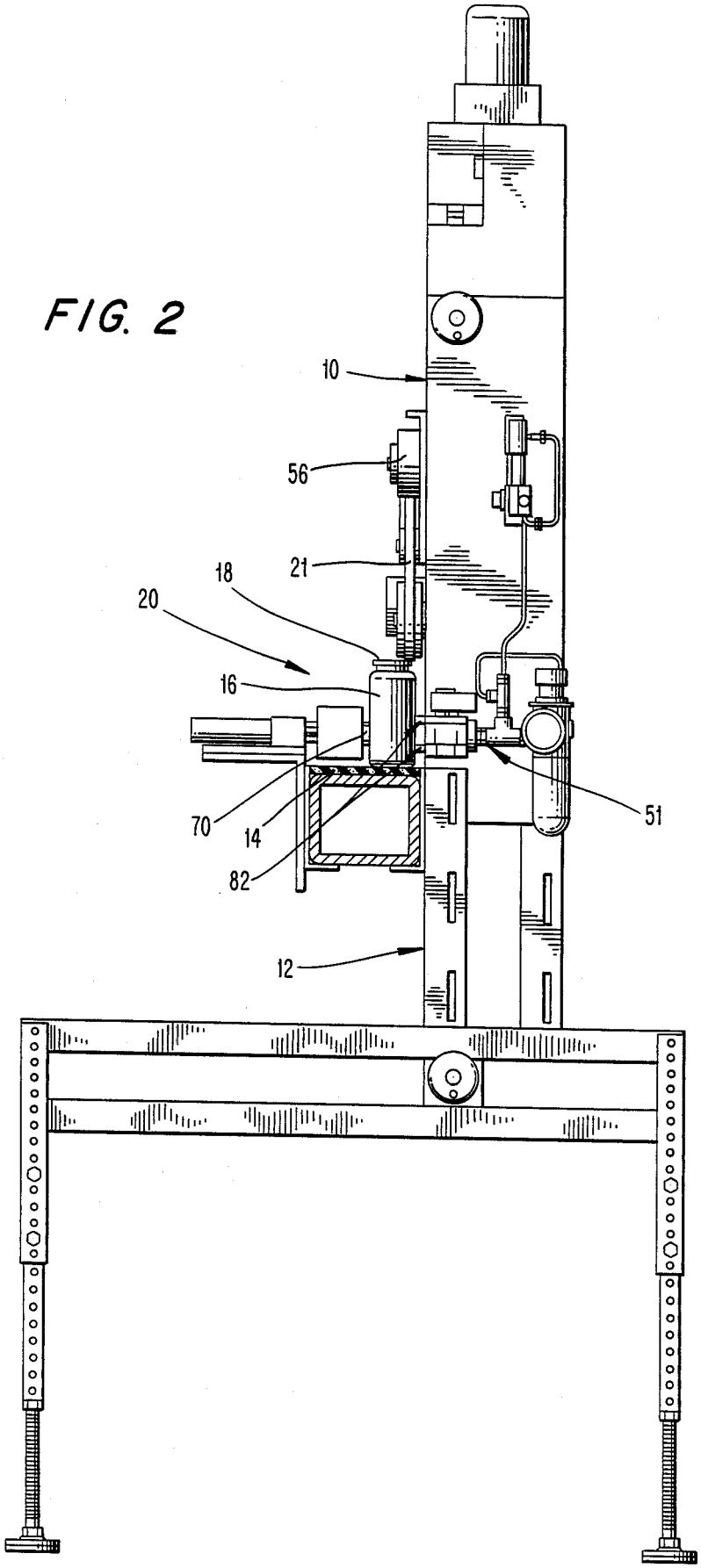
FIG. 2 is a sectional view of the apparatus taken along the line 2—2 in FIG. 1.

The applicator belt is preferably arranged such that the applicator flight contacts only a segment of each bottle rim, as can be seen in FIG. 2. The drive pulleys 26, 28 are actuated to drive the applicator belt such that the application flight travels in the same direction and at the same speed as the conveyor belt 14, whereby there occurs no relative displacement between the application flight and the longitudinal axes L of the bottles.

Figure 3:
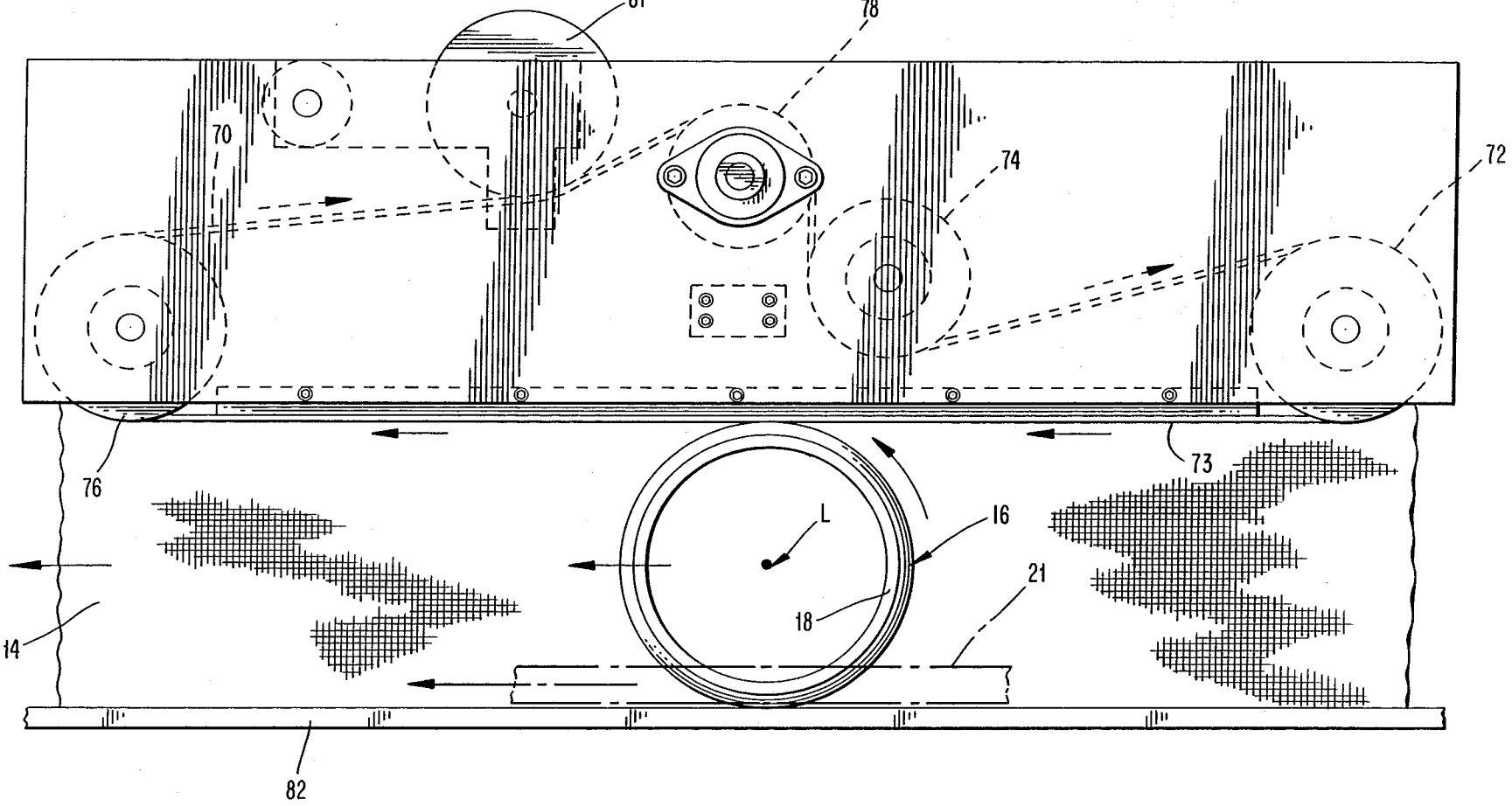
FIG. 3 is an enlarged plan view of a bottle being conveyed through the coating apparatus, whereby a belt for rotating the bottles is viewed in plan, and an applicator belt for applying a liquid substance is depicted in broken lines.

As mentioned earlier, the bottles are caused to rotate about their longitudinal vertical axes L as they are advanced, so as to effect a wiping of the coating substance from the applicator belt to the bottle rims. Such rotation is created by an endless belt 70. The belt 70, which is best depicted in FIG. 3, lies in a horizontal plane and includes a rotation-inducing flight 72 extending parallel to the path of travel of the bottles and in contact with side walls of the bottles. The belt extends around three free-wheeling support pulleys 72, 74, 76 having vertical axes of rotation. The belt 70 also extends around a drive pulley 78 which is driven by a motor 80 through suitable gearing (not shown). A pivoted tensioning roller 81 bears against the belt 70.

The belt 70 can be driven faster or slower than the speed of advancement of the bottles, in order to effect a rotation of the bottles about their longitudinal vertical axes L. Thus, the axes remain stationary relative to the applicator belt, while the rims rotate relative to the applicator belt about the respective axes L. In so doing, the entire rim of each bottle will come into wiping engagement with the application flight of the applicator belt so as to be completely coated with the coating substance.

The sides of the bottles 16 disposed opposite the belt 70 bear against a pair of resilient, high-friction surfaces, preferably formed by resilient tubing 82 available from Norton Co. of Worcester, Mass. under the trade name Tygon Tubing ®. The tubes are fixed to the frame 22 in vertically spaced relationship. Sliding of the containers along the tubes is resisted by the high frictional characteristic of the tubes, whereby rotation of the containers is promoted.

IN OPERATION, bottles 16 are advanced by the conveyor belt, with their rims 18 exposed in an upward direction. The rims come in contact with the application flight 36 of the applicator belt 21 and travel at the same speed, and in the same direction, as that application flight, whereby there occurs no relative movement between the application flight and the longitudinal axes L of the bottles. While the rims contact the application flight, the bottles are rotated about the longitudinal axes L by the belt 70, whereby the entire rim of each bottle comes into contact with the application flight and is coated with the hydrophobic substance carried by the applicator belt.

In accordance with the present invention, the coating substance is applied to the rims in a uniform and drip-free manner. That is, since the moisture content of the applicator belt is maintained constant by the nip rolls 28, 56, the amount of substance applied to the rim will be constant as well. An effective application of the substance to the rims is assured by the wiping action which occurs as the rims are rotated relative to the applicator belt. Any tendency for the substance to drip or run down the side of the bottle is minimized by the fact that the bottles are advanced in the same direction and at the same speed as the applicator belt. Therefore, the only relative movement which occurs between the rim and the applicator belt comprises the rotation of the rims about their vertical axes. However, during such rotation, no edges of the rim scrape against the applicator belt in a manner which would cause runs or drips.

The use of an endless belt as an applicator enables the bottles to be treated at a high rate and is thus ideally suited to mass production. Also, a simplified drive mechanism, such as one or more drive pulleys, is necessary to drive the belt.

Although the present invention has been described in connection with a preferred embodiment thereof, it will be appreciated by those skilled in the art that modifications, substitutions, additions and deletions not specifically described may be made without departing from the spirit and scope of the invention as defined in the appended claims.

What is claimed is:

1. A method of coating the rims of containers with a substance, comprising the steps of:

driving an endless applicator belt which carries said substance, said applicator belt including an application flight;

advancing containers in the same direction and at the same speed as said application flight, with rims of said containers exposed and in contact with said application flight to become coated with said substance;

rotating said containers about longitudinal axes defined by said rims, while said rims are in contact with said application flight for applying a coating which extends completely around each rim.

2. A method according to claim 1, wherein excess substance is removed from said applicator belt by passing said applicator belt through a nip defined by a pair of rollers.

3. A method according to claim 1, wherein said containers are rotated by engaging sides of said containers with a rotation-inducing endless belt which travels at a speed different from the speed of advancement of said containers.

4. A method according to claim 3, wherein sides of said containers opposite said rotation-inducing belt engage a resilient, high-friction surface which promotes rotation of said containers.

5. A method according to claim 1, wherein said containers are rotated by contacting side walls thereof by a flight of a rotation-inducing endlessly driven belt driven at a speed different from the speed of advancement of the containers.

6. A method according to claim 1, wherein said containers comprise glass bottles which are coated on their rims with a liquid substance making said rims hydrophobic.

7. A method according to claim 1, wherein said application flight is disposed in contact with only a segment of each rotating rim.

8. A method of coating the rims of containers with a liquid substance, comprising the steps of:

driving an endless applicator belt which includes an application flight;

transferring said substance in liquid form to said applicator belt and thereafter removing excess substance from said applicator belt;

advancing containers in the same direction, and at the same speed, as said application flight, with rims of said containers exposed, whereby at least segments of said rims contact said application flight and become coated with said substance; and rotating said containers about longitudinal axes defined by said rims, while said rims are in contact with said application flight for applying a coating which extends completely around each rim.

9. Apparatus for coating the rims of containers with a substance, comprising:

a driven endless applicator belt for carrying said substance, said applicator belt including an application flight; and means for advancing containers in the same direction and at the same speed as said application flight, with rims of said containers exposed and in contact with said application flight to become coated with said substance; and means for rotating said containers about longitudinal axes defined by said rims, while said rims contact said application flight for applying a coating which extends completely around each rim.

10. Apparatus according to claim 9 including removal means for removing excess substance from said applicator belt, said removal means including a press roll and a pressure roll defining a nip through which said belt is passed.

11. Apparatus according to claim 9, wherein said means for rotating said containers comprises a rotation-inducing endless belt including a flight traveling parallel to the direction of advancement of said containers and in contact with sides of said containers.

12. Apparatus according to claim 11 including a resilient, high-friction surface disposed opposite said rotation-inducing belt for contacting the sides of said containers to promote rotation thereof.

13. Apparatus according to claim 9, wherein said means fo rotating said containers comprises a driven endless belt driven at a speed different from the speed of advancement of said containers.

14. Apparatus according to claim 9, wherein said application flight is disposed in contact with only a segment of each said rim.

15. Apparatus for coating the rims of containers with a liquid substance, comprising:

a driven endless applicator belt including an application flight;

transferring means for transferring said substance in liquid form to said applicator belt;

removing means for removing excess substance from said applicator belt;

means for advancing containers in the same direction, and at the same speed, as said application flight, with rims of said containers exposed and at least segments of said rims contacting said application flight to become coated with said substance; and means for rotating said containers about longitudinal axes defined by said rims, while said rims contact said application flight for applying a coating which extends completely around each rim.

* * * * *